United States Patent [19]

Mixon, Jr. et al.

[11] 4,192,214

[45] Mar. 11, 1980

[54] SUPPORT DEVICE FOR MUSICAL INSTRUMENTS

[76] Inventors: James L. Mixon, Jr., 5129 Irene Dr., Harrisburg, Pa. 17112; Mark L. Sherman, 3613 Walnut St., Harrisburg, Pa. 17109

[21] Appl. No.: 943,240

[22] Filed: Sep. 18, 1978

[51] Int. Cl.[2] ..... G10G 5/00

[52] U.S. Cl. ..... 84/327; 248/289 R

[58] Field of Search ..... 84/327, 278, 280, 385 B, 84/387 A, 290; 248/289 R

[56] References Cited

U.S. PATENT DOCUMENTS

| | | | |
|---|---|---|---|
| 856,804 | 6/1907 | Piper | 84/327 |
| 1,342,202 | 6/1920 | Cox | 84/327 |
| 1,369,742 | 2/1921 | Halpin | 248/175 |
| 1,673,205 | 6/1928 | Ramco | 211/13 |
| 1,684,912 | 9/1928 | Dunklan | 211/13 |
| 2,133,356 | 10/1938 | Luttbeg | 84/376 R |
| 2,517,896 | 8/1950 | Lawrence | 248/460 |
| 3,251,258 | 5/1966 | Parker | 84/453 |
| 3,958,786 | 5/1976 | Mann | 248/176 |

*Primary Examiner*—L. T. Hix
*Assistant Examiner*—Benjamin R. Fuller
*Attorney, Agent, or Firm*—Allan B. Osborne

[57] ABSTRACT

The present invention relates to a support device for musical instruments. More particularly, it includes a device which is an integral part of the instrument and consists of a first ring member adapted to be fixed to the instrument, a second ring member adapted to support the instrument on the floor and hinge means connected to the first and second ring members whereby the second member may be rotated into a closed position against the instrument without interfering with the playing thereof.

6 Claims, 8 Drawing Figures

SUPPORT DEVICE FOR MUSICAL INSTRUMENTS

BACKGROUND OF THE INVENTION

1. Field of the Invention

This invention relates to a support device for stringed musical instruments.

2. Prior Art

The prior art devices are for the most part, free-standing and are adapted to support the instrument in a vertical position without means of attachment thereto.

An example of one such device is disclosed in U.S. Pat. No. 1,673,205 which issued to August Romao. His stand consists of three legs arranged as a tripod. A vertical member extends upwardly from the junction of the legs. A pair of pins project forwardly from two of the legs in the same plane as the vertical member. The musical instrument rests on the pins and against the vertical member. No means for attaching the instrument to the stand are shown.

SUMMARY OF THE INVENTION

The present invention discloses a device which is attached to a stringed musical instrument in such a manner as to blend in with the instrument and so as not to interfere with the playing thereof. One member of the device may be rotated to provide a stand whereby the instrument may be placed on the floor in a vertical position when not in use. Locking means are provided so that the device cannot inadvertently open or collapse.

DESCRIPTION OF THE INVENTION

Figure 1:
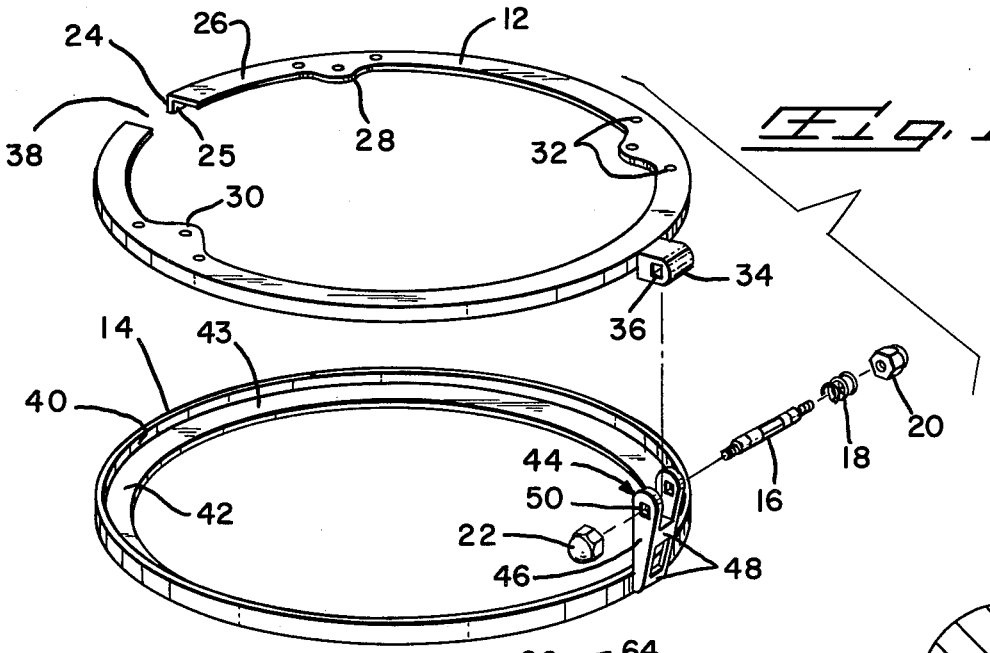
FIG. 1 shows in exploded fashion the components of the preferred embodiment of the present invention.
Figure 3:
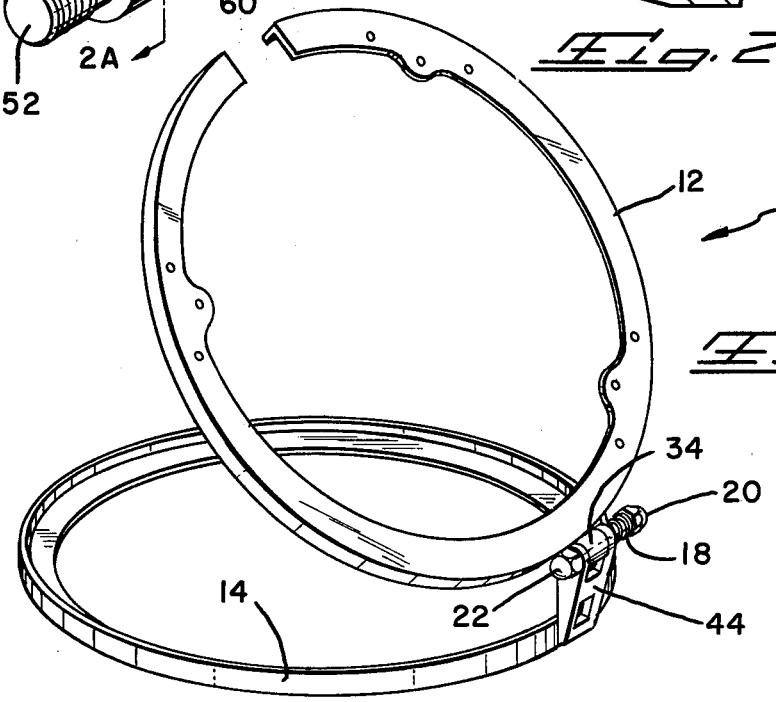
FIG. 3 is a view of the assembled embodiment of FIG. 1.

FIG. 1 shows in exploded fashion the several components which, when assembled, is the support device 10 shown in FIG. 3. These components include a top or first member, ring 12, a base or second member, ring 14, locking and hinge pin 16, coil spring 18 and acorn nuts 20 and 22. Preferably the two members are stamped and formed from steel, aluminum or brass. Other materials, such as a rigid plastic could also be used as well as other manufacturing methods. The hinge pin is made from hardened stainless steel or an equivalent material.

The top ring 12 is L-shaped in cross-section with side wall 24 being shorter in length than flange wall 26. The two walls define an inwardly open channel 25. The flange wall has three inwardly projecting noses 28, each having a hole 30 near the end. Other holes 32 in the flange wall bracket each nose.

A pin housing 34 is silver soldered or otherwise fixed centrally to side wall 24. A squared passage 36 extends through the housing tangential to the member.

Directly opposite the location of housing 34, the ring member's continuity is interrupted by slot 38. As will be seen later, this slot accommodates the neck of the musical instrument to which device 10 is attached.

Base ring member 14 is also L-shaped in cross-section with its side wall 40 being of lesser length than its flange wall 42. The two walls also define an inwardly open channel 43.

A hinge bracket 44 is fixed to side wall 40 by silver solder or other suitable means, depending, of course, on the material of the ring member. The bracket, which may be formed or cast from most ferous or non-ferous materials, such as bronze and steel, preferably has two spaced apart, elongated side rails 46 with two reinforcing cross bars 48. Square holes 50 pass through each rail adjacent their free ends.

The hinge bracket can be made in one piece by casting or, more expensively, milling.

Figure 2:
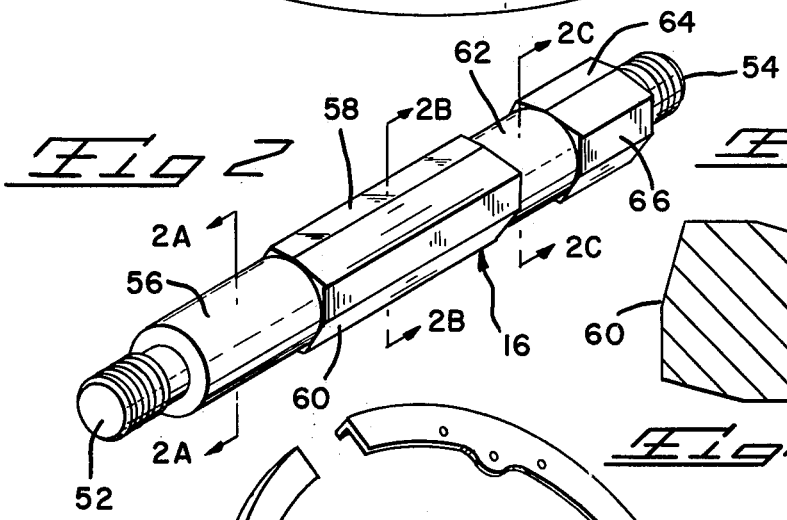
FIGS. 2, 2A through 2C show the locking and hinge pin of the present invention.
Figure 2A:
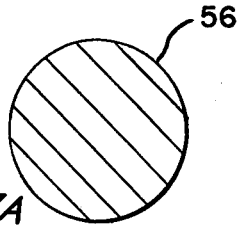

The details of hinge pin 16 is shown clearly in FIGS. 2, 2A through 2C. Threaded studs 52 and 54 project outwardly from the left and right ends respectively. Immediately inwardly from the stud 52, a section of the pin is round as indicated by reference numeral 56. FIG. 2*a* is a cross-sectional view of section 56.

Figure 2B:
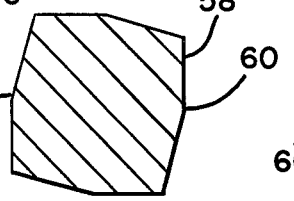
Figure 2C:
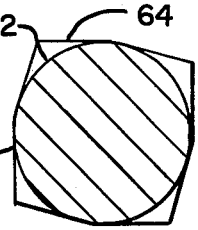

A length of the pin, indicated by reference numeral 58, to the right of section 56, is generally square in cross-section as seen in FIG. 2*b*. The four flats, each designated by reference number 60, are each slightly convex.

A second but shorter round section 62 is found immediately to the right of the above-mentioned section 58, and a second but shorter square section 64 is found between section 62 and threaded stud 54. Its flats 66 are also slightly convex. Sections 62 and 64 can be seen in cross-section in FIG. 2*c*.

FIG. 3 shows the assembled support device in an open position. The top ring member is hinged to the base ring member via housing 34, bracket 44 and pin 16. The housing fits between side rails 46 with pin 16 passing through holes 50 (in the rails) and squared passage 36 in the housing. The coil spring 18 slides onto the first round section 56 which extends beyond or outside of a side rail 46. The spring is confined by acorn nut 20. Acorn nut 22 is threaded onto stud 54 which extends outwardly from the other side rail 46.

The two ring members are in a normally locked position; i.e., neither can move relative to the other. The locking is a result of the hinge pin's square sections 58 and 64 being positioned in square holes 50 in the bracket's two side rails and squared passage 36 in housing 34. When it is desired to move the ring members relative to each other, pressure is applied to acorn nut 20 which pushes pin 16 towards the opposite side rail and compresses spring 18. This moves the square sections out of holes 50 and moves the round sections, 56 and 62, into the square holes. The ring members may be adjusted freely as the round sections rotate easily within the square holes. Upon releasing pressure against acorn nut 20, coil spring 18 expands, pushing on nut 20 to shift pin 16 back to its normally locked position.

Figure 4:
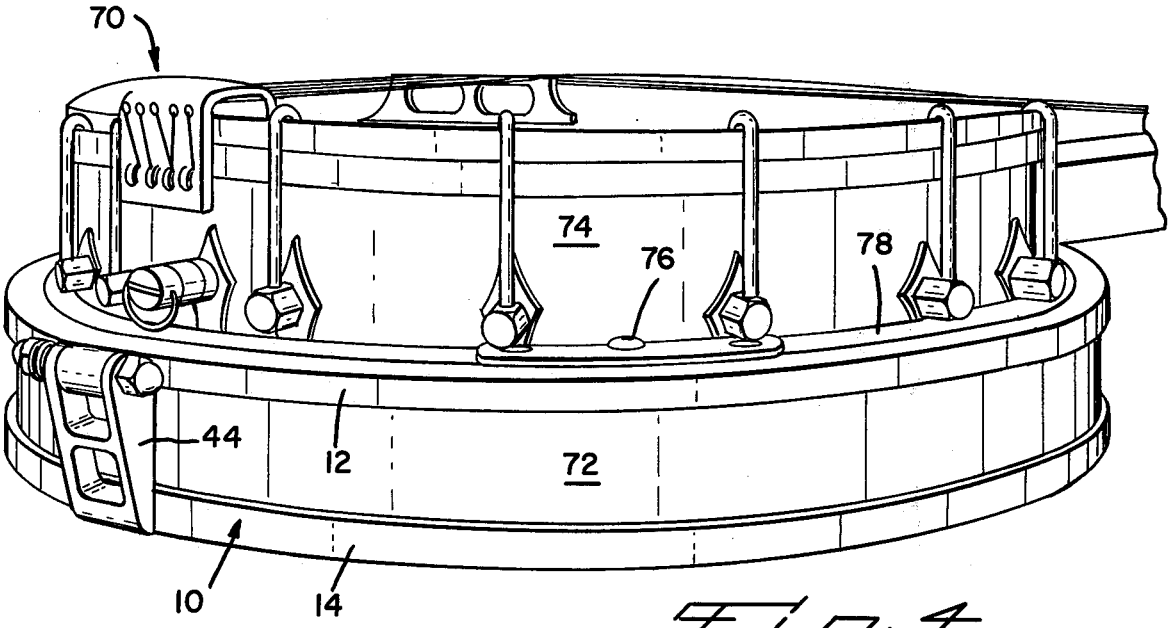
FIG. 4 shows the assembled embodiment of FIG. 1 attached to a musical instrument in a closed position.

FIG. 4 is a view showing support device 10 attached to banjo 70. The banjo is a conventional string instrument with a resonator box 72 attached to the drum or head 74. The device is removably attached to the banjo by bolts or screws 76 passing through appropriate holes in the resonator, tone ring or flange 78 on the banjo and holes 30 in the top ring member's noses 28. Bracket 44 extends along side the resonator box with base ring member 14 encircling its lower perimeter. The edges of the box fit into channels 25 and 43. Preferably these channels are lined with felt or other like material to protect the instrument finish and its sound qualities.

Obviously top ring member 12 may be modified to accept other means for fastening support device 10 to a banjo or other stringed instrument. Bracket 44 may also be made longer or shorter or shaped to accept the dimensions of other instruments.

The support device as shown in FIG. 4 is in a closed position; i.e., base ring member 14 is against resonator box 72. It can be clearly seen and appreciated that the banjo may be carried and played with the device attached without intefering in the least. Further, the banjo may be put in a carrying case (not shown) with support device 10 attached.

Figure 5:
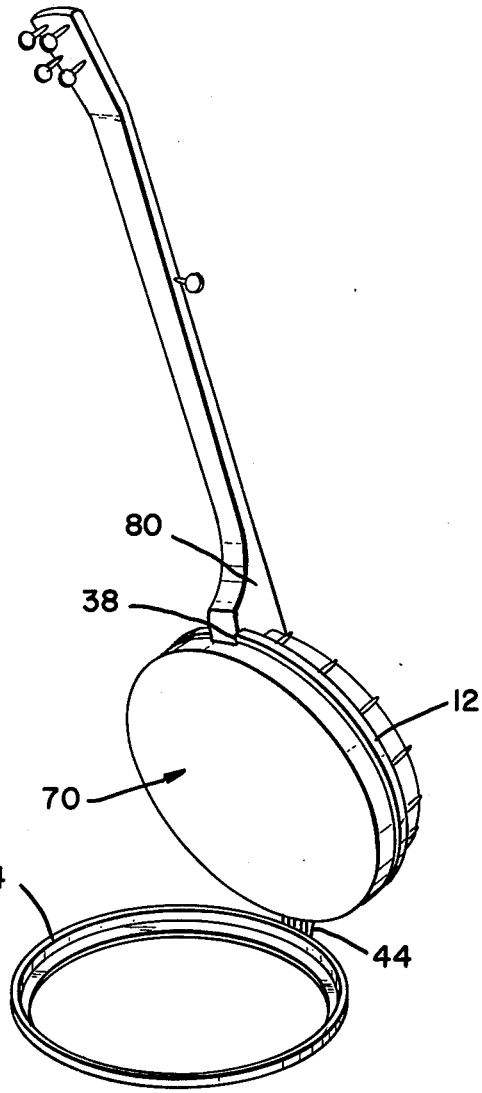
FIG. 5 is a view of the embodiment attached to a musical instrument in an open position supporting the instrument.

FIG. 5 shows device 10 in an opened mode supporting banjo 70 in a nearly vertical position completely independently; i.e., without other supporting structures. When the player wishes to set aside his instrument, either to take a rest, play another or to display it, he depresses acorn nut 20 and rotates base ring member 14 away from the banjo for about forty-five degrees. Releasing the nut locks the ring members in that relative position which enables the player to sit the instrument down as shown in the drawing. As noted above, the banjo is free-standing and its finish will not be marred or damaged by resting against a wall or lying on a chair or floor.

FIG. 5 also shows how slot 38 accommodates neck 80 on the banjo as it passes through ring member 12.

In summary, the present invention provides a support device which becomes an integral part of a stringed musical instrument and which can be adjusted to a closed or stored position for playing and to an open position for independently supporting the instrument while not in use.

One advantage of the device is that it can be temporarily or permanently attached to an instrument and conveniently stored therewith while the instrument is being played. It is inconspicuously mounted but even so, adds to the pleasing appearance of the instrument. The device is very easily actuated to either closed or opened positions. Further, the open position may be at any angle desired by providing other passage and hinge pin configurations.

The several drawings and the above description of the present invention illustrate the preferred embodiment. Such drawings and description however are not to be taken as limiting the principals of the invention as modifications to the device can now be made with the benefit of the above teachings.

For example, the second ring member can be modified to a rectangular plate-like member (not shown) which lies across the back of the instrument when in the closed position.

Accordingly, the scope of the invention is to be defined by the terms of the following claims as given meaning by the preceding description.

We claim:

1. A support device for stringed musical instruments comprising:

a. a first member adapted to be removably attached on an instrument at a distance spaced inwardly from the instruments' back side;

b. a second member adapted to fit against the instruments' back side; and c. hinge means comprising a pin receiving housing on one member, a bracket on another member with side rails extending to either side of the pin receiving housing, and a pin passing through the side rails and housing so that the second member may be rotated away from the instrument to a position for supporting the instrument.

2. The hinge means of claim 1 wherein the pin receiving openings in the housing and side rails are square.

3. The hinge means of claim 2 wherein the pin has square and round sections so that when the square sections are positioned in the openings in the side rails, the first and second members cannot be rotated relative to one another.

4. The hinge means of claim 3 further including biasing means for removably retaining the square sections on the pin in registration with the square openings in the side rails.

5. The hinge means of claim 4 further including means for sliding the pin so that the square sections on the pin move out of registration with the side rail square openings so that the two members may be rotated with respect to each other.

6. The hinge means of claim 4 wherein the biasing means includes a coil spring positioned on the pin outside of one of the side rails.

* * * * *